United States Patent [19]

Nielsen

[11] 4,418,864

[45] Dec. 6, 1983

[54] CARTON WITH HANDLE

[75] Inventor: John C. Nielsen, St. Clair, Australia

[73] Assignee: Visymonde Investment PTE Ltd., Singapore, Japan

[21] Appl. No.: 423,470

[22] Filed: Sep. 24, 1982

[30] Foreign Application Priority Data

Dec. 21, 1981 [AU] Australia ..... PF2026

[51] Int. Cl.[3] ..... B65D 5/46; B65D 25/28

[52] U.S. Cl. ..... 229/52 B

[58] Field of Search ..... 229/52 B, 52 AL

[56] References Cited

U.S. PATENT DOCUMENTS

| | | | |
|---|---|---|---|
| 2,955,739 | 10/1960 | Callura | 229/52 B |
| 2,986,324 | 5/1961 | Anderson | 229/52 B |
| 3,591,070 | 7/1971 | Vrana | 229/52 B |
| 4,010,888 | 3/1977 | Gilbert | 229/52 B |
| 4,311,268 | 1/1982 | Saliven | 229/52 B |
| 4,331,289 | 5/1982 | Killy | 229/52 B |

FOREIGN PATENT DOCUMENTS

| | | | |
|---|---|---|---|
| WO81/00090 | 1/1981 | PCT Int'l Appl. | 229/52 B |

*Primary Examiner*—Herbert F. Ross

*Attorney, Agent, or Firm*—Cushman, Darby & Cushman

[57] ABSTRACT

A carton having side walls and end closing flaps, said carton including at one end a pair of inner closing flaps and a pair of outer covering flaps, said outer covering flaps having their edges in substantially abutting relationship along a line extending substantially across the middle of the carton, said outer flaps each having portions adjacent their free edges which are at least substantially separable from said flaps, and a strip of reinforcing tape overlying said portions of said outer flaps and secured to the side walls of said carton to define with said portions a carrying handle for said carton. The specification also discloses a carton blank from which the above carton is formed.

9 Claims, 3 Drawing Figures

CARTON WITH HANDLE

BACKGROUND OF THE INVENTION

This invention relates to cartons and other paper board or like containers having integral carrying handles, and to blanks for forming such cartons and containers. The invention is particularly applicable to cartons having integral handles, suitable for use as wine casks but the invention is equally applicable to other cartons which have a need to be carried during use after purchase.

Australian Patent Application Nos. 518,142 (AU-B 56613/80) and 518,339 (AU-B 60051/80) disclose various cartons having integral handles suitable for use as wine casks. Application No. 518,339 relates to a carton in which the handle comprises an end portion of an outer closing flap and an overlying pressure sensitive adhesive tape secured to the end portion and to the sides of the carton to reinforce the handle structure.

While the above described handle construction has certain advantages over other proposals to provide handled cartons, the blank from which the carton is formed is not particularly economical and since the outer closing flaps overlap, the outermost closing flap, from which the handle is formed, is displaced from the inner closing flaps making it difficult to ensure that the closing flap is properly adhered to the inner closing flaps thereby reducing the strength and integrity of the finished carton. Furthermore, the different level created by the overlapping of the outer closing flaps tends to introduce a degree of instability into a vertical stack of such cartons. Similar criticisms apply to the handled carton described in U.S. Pat. No. 2,868,433, and the first criticism is applicable to the cartons described in U.S. Pat. Nos. 2,986,324 and 2,797,556.

It is an object of the present invention to provide an improved carton and blank construction in which the above problems are at least reduced.

The invention accordingly provides a carton having side walls and end closing flaps, said carton including at one end a pair of inner closing flaps and a pair of outer covering flaps, said outer covering flaps having their edges in substantially abutting relationship along a line extending substantially across the middle of the carton, said outer flaps each having portions adjacent their free edges which are at least substantially separable from said flaps, and a strip of reinforcing tape overlying said portions of said outer flaps and secured to the side walls of said carton to define with said portions a carrying handle for said carton.

By forming the portions or "handle strips" from the abutting edge portions of the outer flaps, the blank not only requires the use of less material but also forms a flat-topped carton and facilitates secure adherance of the outer flaps to the inner flaps where adhesive attachment is used.

If desired, either or both of the outer flaps may be formed with finger access opening(s), which need only comprise narrow slots adjacent the "handle strips", to facilitate better access to the "handle strips". However, even if such access openings are not provided, the strip may be rendered accessible by pushing down the adjacent portion of one of the outer flaps and inserting the fingers under the thus exposed "handle strips".

The "handle strips" may be formed in the outer flaps by perforating the flaps along lines parallel to their free edges or by severing the flaps along similar lines. Preferably a connecting portion is left adjacent at least one end of the outer flaps, and preferably adjacent each end of said outer flaps.

The invention also provides a carton blank comprising four side wall portions adapted to be connected to form a tubular carton of generally rectangular cross-section, closing flaps and covering flaps at either end of said blank, said flaps including at one end a pair of inner closing flaps and a pair of outer covering flaps, said outer covering flaps dimensioned so as to have their free edges in substantially abutting relationship in the carton when erected, said outer flaps being formed with means defining at least substantially separable portions adjacent each free edge and which define part of a handle structure in the erected carton.

The carton blank may be formed with any one or more of the preferred features of the above described carton.

DESCRIPTION OF PREFERRED EMBODIMENT

Figure 1:
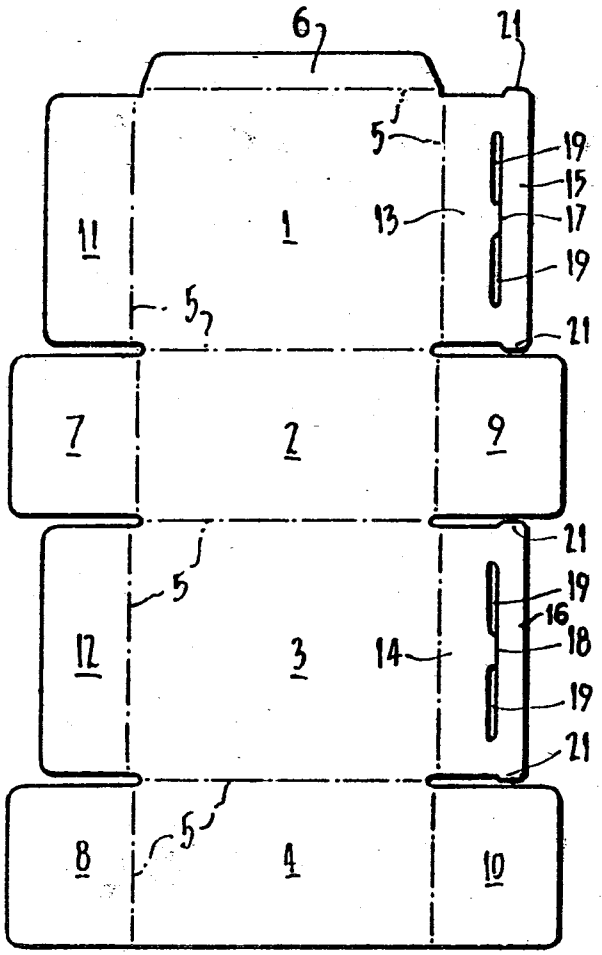
FIG. 1 is a plan view of the blank embodying the invention.

Referring to FIG. 1, the blank will be seen to comprise generally rectangular side walls 1, 2, 3 and 4 defined by score or crease lines 5 and a connecting tab 6 extending from the side wall 1 by means of which the blank may be folded and connected by gluing or otherwise securing the tab 6 to the inner face of the side wall 4 to define a tube of generally rectangular cross section.

The blank also has integral end closing flaps including at each end a pair of inner closing flaps 7, 8 and 9, 10 and a pair of outer covering flaps 11, 12 and 13, 14. The inner closing flaps 7, 8, 9 and 10 are dimensioned so that their free edges are adjacent each other in the erected condition and so that the side edges of each flap are closely adjacent the side walls 1 and 3 in the erected condition to ensure that the carton remains substantially square.

The outer covering flaps 11, 12, 13 and 14 are dimensioned so that their free edges are in substantially abutting relationship in the erected condition so as to fully close the ends of the carton.

The outer covering flaps 13 and 14 at one end of the carton blank are formed with edge portions 15, 16 which are defined by weakening lines 17, 18, such as slits, extending parallel to the free edges of the flaps 13, 14 to define "handle strips". The weakening lines 17, 18 terminate inwardly of the ends of the outer flaps 13, 14 so that the "handle strips" remain connected to the flaps 13, 14. Finger access slots 19 are formed in the covering flaps 13, 14 adjacent the "handle strips" 15, 16.

As an alternative to the above arrangement, the "handle strips" may be defined by perforations or interrupted slits extending partly or wholly across the width of the flaps 13, 14, although the above described arrangement is presently preferred. Similarly, the slots 19 may be of any desired configuration.

The outer covering flaps 13, 14 are secured to the inner closing flaps 9, 10 by conventional means such as glue although care is taken to ensure that the "handle strips" are not glued to the inner closing flaps 9, 10.

Figure 2:
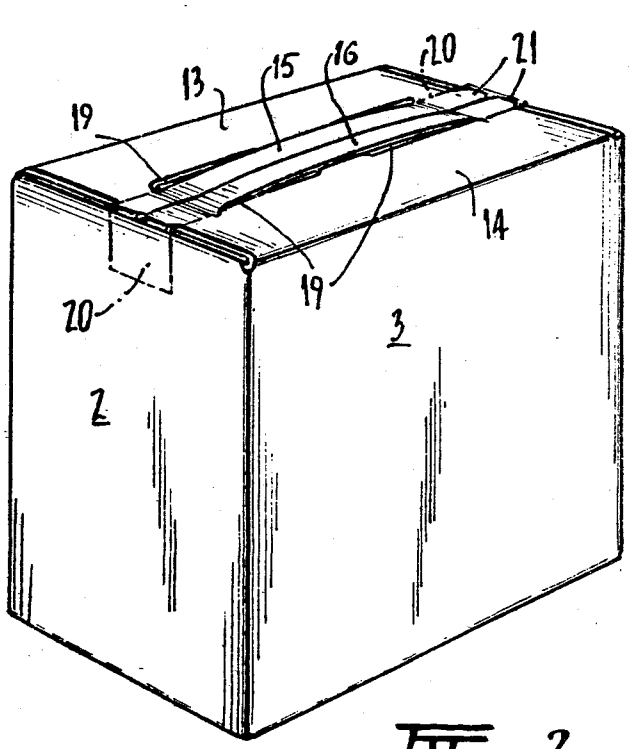
FIG. 2 is a perspective view of a formed carton embodying the invention.

In the erected carton (FIG. 2), a strip of pressure sensitive adhesive tape 20 (shown in broken outline in the drawing), is applied over the "handle strips" 15, 16 of the outer flaps 13, 14 and adhered to the "handle strips" and to the adjacent portions of the side walls 2, 4 to provide an integral handle structure formed from the "handle strips" and the overlying adhesive tape strip 20. The tape 20 is preferably a suitable plastics tape such as a polyester tape of suitable strength. The covering flaps 13, 14 are provided with lugs 21 at either end of each edge portion or "handle strip" 15, 16 to provide loose tape to enable the handle to be lifted when the carrier's fingers are inserted in the slots 19 and under the "handle strips" 15, 16.

It will be appreciated that the finger access openings 19 need not be formed in both of the flaps 13, 14 and in fact may be omitted altogether without substantially affecting the performance of the handle, as described earlier.

The blank from which the carton is formed may be made from any suitable board but where the carton is for use as a wine cask, it is preferably made from corrugated board such as Visy Board Type 4005 E Flute. Of course the carton may be formed from any other suitable board or from some suitable plastics substitute.

The above described blank profile will be seen to be particularly economical to manufacture and since the "handle strips" are formed from the edges of the outer closing flaps, the end of the carton will be flat which not only facilitates adequate gluing of the outer flaps to the inner flaps but also facilitates more stable vertical stacking.

Figure 3:
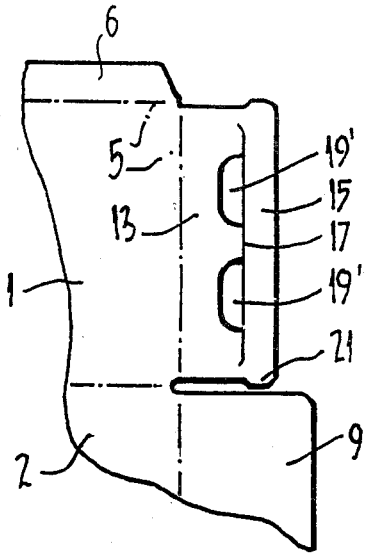
FIG. 3 is a fragmentary plan view of part of a blank showing a modification according to the invention.

In the modification shown in FIG. 3 of the drawings, the finger access slots are enlarged to provide substantially D-shaped openings 19' which enable a greater degree of access to the "handle strips" 15, 16. The other flap 14 (not shown) is identical to the flap 13 and the function of this embodiment is otherwise identical to the previous embodiment.

What I claim is:

1. A carton having side walls and end closing flaps, said carton including at one end a pair of inner closing flaps and a pair of outer covering flaps, said outer covering flaps having their edges in substantially abutting relationship along a line extending substantially across the middle of the carton, said outer flaps each having portions adjacent their free edges which are at least substantially separable from said flaps, and a strip of reinforcing tape overlying said portions of said outer flaps and secured to the side walls of said carton to define with said portions a carrying handle for said carton.

2. The carton of claim 1, wherein the outer flaps are adhesively secured to the inner flaps except at said portions.

3. The carton of claim 1 or 2, wherein at least one of said outer flaps are formed with finger access openings adjacent at least one of said portions.

4. The carton of claim 1, wherein said portions are defined by weakening lines running parallel to said free edges and terminating inwardly of the ends of said outer flaps.

5. The carton of claim 1, wherein said reinforcing tape is adhesive tape.

6. The carton of claim 3, wherein said portions are defined by weakening lines running parallel to said free edges and terminating inwardly of the ends of said outer flaps.

7. A carton blank comprising four side wall portions adapted to be connected to form a tubular carton of generally rectangular cross-section, closing flaps and covering flaps at either end of said blank, said flaps including at one end a pair of inner closing flaps and a pair of outer covering flaps, said outer covering flaps being dimensioned so as to have their free edges in substantially abutting relationship in the carton when erected said outer flaps being formed with means defining at least substantially separable portions adjacent each free edge and which define part of a handle structure in the erected carton.

8. The blank of claim 7, wherein said portions are defined by weakening lines which terminate inwardly of the ends of said outer flaps.

9. The blank of claim 7, further comprising finger access openings adjacent at least one of said portions.

* * * * *